US006459058B1

(12) United States Patent
Shinohe et al.

(10) Patent No.: US 6,459,058 B1
(45) Date of Patent: Oct. 1, 2002

(54) OPERATING DEVICE HAVING OPERATING BUTTON ADAPTED TO SLIDE IN HOUSING WHILE BEING PUSHED TO EFFECT SWITCHING OPERATION

(75) Inventors: Akihiro Shinohe; Masahiro Soma, both of Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/481,107

(22) Filed: Jan. 11, 2000

(30) Foreign Application Priority Data

Jan. 18, 1999 (JP) ..... 11-008871

(51) Int. Cl.[7] ..... H01H 9/00
(52) U.S. Cl. ..... 200/341; 200/517; 200/296
(58) Field of Search ..... 200/512, 517, 200/520, 341, 294–296, 344, 345

(56) References Cited

U.S. PATENT DOCUMENTS

| | | | | |
|---|---|---|---|---|
| 4,556,769 A | * | 12/1985 | Inaba | 200/340 |
| 4,755,645 A | * | 7/1988 | Naoki et al. | 200/340 |
| 5,172,990 A | * | 12/1992 | Weng | 400/490 |
| 5,595,285 A | | 1/1997 | Santo | 200/330 |
| 5,716,274 A | | 2/1998 | Goto et al. | |
| 5,821,490 A | | 10/1998 | Blossfeld | 200/324 |
| 6,150,621 A | * | 11/2000 | Nishitani et al. | 200/61.54 |
| 6,192,815 B1 | * | 2/2001 | Duttenhofer | 112/277 |
| 6,239,726 B1 | * | 5/2001 | Saida | 340/999 |
| 6,242,705 B1 | * | 6/2001 | Huang | 200/520 |

FOREIGN PATENT DOCUMENTS

| | | | |
|---|---|---|---|
| EP | 0 572 860 A1 | 5/1993 | G05G/1/02 |
| EP | 0 867 212 A1 | 9/1998 | A63F/9/22 |
| GB | 2 288 282 A | 10/1995 | H01H/71/02 |
| JP | 08007703 | 12/1996 | H01H/25/04 |

OTHER PUBLICATIONS

"Molded Push/Push Knob Design"; 2244 Research Disclosure; May 1, 1990; Industrial Opportunities Ltd. Havant, Emsworth, Great Britain; No. 313; p. 419; XP000114885.

* cited by examiner

*Primary Examiner*—Michael Friedhofer
(74) *Attorney, Agent, or Firm*—Brinks Hofer Gilson & Lione

(57) ABSTRACT

An operating device to be used, for example, as an input portion for a game controller. The operating device comprises a housing, a push button, and a switch base comprising a switch portion and a support base. The housing is provided with a support member for supporting the switch base and is also provided with an anti-dislodgement retaining portion for preventing the push button from coming off to the exterior from the housing. The push button is provided with a retaining lug for engagement with the anti-dislodgement retaining portion of the housing and is also provided with a retaining lug for engagement with the support base in the switch base. The support base is provided with an anti-dislodgement retaining portion for engagement with the retaining lug of the push button and is also provided with a guide portion. With this guide portion, the movement of the push button is guided in its pushing direction and is prevented from wobbling in the vertical direction.

4 Claims, 5 Drawing Sheets

OPERATING DEVICE HAVING OPERATING BUTTON ADAPTED TO SLIDE IN HOUSING WHILE BEING PUSHED TO EFFECT SWITCHING OPERATION

BACKGROUND OF THE INVENTION

1. Field of the Invention

The present invention relates to an operating device to be used, for example, as an input portion for a game controller. Particularly, the invention is concerned with an operating device wherein an operating button is pushed and is allowed to slide within a housing to effect a switching operation.

2. Description of the Related Art

FIG. 6 is an exploded perspective view showing a part of an operating device for a game controller. As shown in the same figure, the operating device is provided with a housing 30, a push button 31, a presser member 32, and a switch (not shown) which is operated by the push button 31. The switch is mounted on a printed circuit board received within the housing 30.

The housing 30 is formed with a forwardly projecting receptacle portion, and in a front side of the housing 30 is formed an insertion opening 38, while in the interior of the housing 30 is disposed a support member 35. In the support member 35, a support plate 35*a* is formed integrally with the housing 30, and at both ends of the support member 35 are formed support plates 35*b* respectively also in one piece with the housing 30. The support plates 35*b* support a part of the push button 31. The support plate 35*a* comprises support plates 35*a*1, 35*a*2 and 35*a*3, of which the support plate 35*a*2, located centrally, is formed with a tapped hole 37 in an upper end thereof. Further, pins 36 extend upward respectively from the support plates 35*a*1 and 35*a*3 which are located on both sides of the support plate 35*a*2. Near the insertion hole 38 are formed a pair of anti-dislodgement retaining portions 35*c*, one of which is not shown, for preventing outward dislodgement of the push button 31.

The push button 31 is formed with a pair of slide portions 45 at both ends thereof, the slide portions 45 being longer at their lower portions than at their upper portions. The slide portions 45 are formed in an inverted L shape so as to cover upper ends of the support plates 35*b*. On an upper surface of the push button 31 is integrally formed a retaining lug 40 projecting upward, while on side faces of the push-button switch are integrally formed retaining lugs 39 projecting sideways and outward.

The presser member 32, which is a plate member, is formed with a screw insertion hole 41, pin insertion holes 42 for insertion of pins 36 therein, the pin insertion holes 42 being located on both sides of the screw insertion hole 41, and an opening 43. The opening 43 is partially cut out to form an anti-dislodgement retaining portion 44 for insertion of the retaining lug 40 therein.

In assembling the operating device thus constructed, the push button 31 is inserted into the housing 30 from above the housing so as to project outward from the insertion opening 38. At this time, the push button 31 is retained by the retaining lugs 39 and the anti-dislodgement retaining portions 35*c*, whereby the push button 31 is prevented from coming off to the exterior of the housing 30.

After or before the mounting of the push button 31, the foregoing printed circuit board with a switch mounted thereon is inserted into the housing 30 so as to be positioned between the support member 35 and the push button 31. Then, the presser member 32 is mounted from above the push button 31, whereby the push button 31 is established its position. At this time, the pin insertion holes 42 are fitted on the pins 36 respectively, and after positioning for registration between the tapped hole 37 and the screw insertion hole 41, a screw 34 is inserted into both holes from the presser member 32 side and is tightened. At the same time, the retaining lug 40 is inserted into the anti-dislodgement retaining portion 44, whereby the push button 31 is prevented from projecting to a larger extent than a predetermined length.

In the above operating device, when the push button 31 is pushed, the slide portions 45 slide on the upper ends of the support plates 35*b*, and by the bottoms of a pair of frame portions 46 of the presser member 32 the push button 31 is prevented from tilting forward and coming off to the exterior from the housing 30.

However, in the conventional operating device described above, the assembling process is troublesome and it has so far been impossible to manufacture the device inexpensively.

In assembling the above conventional operating device it is necessary to insert the push button 31 into the housing 30 from above, allow it to project forward from the insertion hole 38, effect subsequent positioning of the push button 31 with the presser member 32, and then fasten the push button with the screw 34. With the push button 31 merely inserted into the housing 30, the push button may project too much from the insertion hole 38 due to a curved shape of the housing 30 or of the push button, or it may assume an oblique position, thus making engagement of the retaining lug 40 with the anti-dislodgement retaining portion 44 impossible and hence making it impossible to effect positioning of the presser member 32. Therefore, for making the retaining lug 40 and the anti-dislodgement retaining portion 44 engageable with each other, it is required to mount the presser member 32 while adjusting in which direction the push button 31 should face for example.

Besides, since it is necessary to use the presser member 32 and the screw 34, the number of components used increases, which is disadvantageous in point of cost. In the case where there are used plural such operating devices, the manufacturing process becomes more complicated and it takes a longer time, thus making it impossible to effect a less expensive manufacture.

SUMMARY OF THE INVENTION

The present invention has been accomplished for solving the above-mentioned problems and it is an object of the invention to provide an operating device capable of being assembled easily and being manufactured less expensively.

According to the present invention there is provided an operating device comprising a housing, a push button attached to the housing, and a switch portion adapted to be operated by the push button, wherein a support base for supporting the switch portion is received within the housing, the push button is inserted into the housing at a position at which it can push the switch portion and opposedly to the switch portion, and an anti-dislodgement retaining portion for preventing the push button from coming off to the exterior of the housing is formed between the support base and the push button.

Preferably, the support base is provided with a guide portion for restricting the movement of the push button in a direction perpendicular to a pushing direction of the push button and for guiding the movement of the push button in the pushing direction.

According to this construction, not only the push button can be guided in its pushing direction by utilizing the support base which supports the switch portion, but also the movement of the push button in a direction perpendicular to its pushing direction can be restricted. Besides, since it is not necessary to use any positioning or screwing component for the push button, the number of components used can be decreased, thus permitting a less expensive manufacture.

Moreover, the anti-dislodgement retaining portion not only prevents the push button from coming off to the exterior from the housing but also prevents the push button from projecting to the exterior of the housing to an excess degree beyond a predetermined length. Further, the foregoing guide portion can restrict the movement of the push button in a direction perpendicular to the pushing direction and thereby prevent the occurrence of wobbling.

Preferably, the housing is provided with a restricting portion opposedly to the push button on the side opposite to the guide portion to restrict the vertical movement of the push button in cooperation with the guide portion.

By providing the restricting portion, not only the push button can be guided in its pushing direction, but also it is possible to prevent wobbling of the push button in the vertical direction.

Preferably, an anti-dislodgement retaining portion for preventing the push button from coming off to the exterior of the housing is provided between the housing and the push button.

In this connection it is preferable for the push button to have an elastically deformable lug to be engaged with the anti-dislodgement retaining portion and is preferable that the push button is inserted by snap-in fitting from the exterior of the housing into an insertion opening formed in the housing.

According to this construction, the push button can finally be fitted in the housing from the exterior of the housing after the support base including the switch-portion has been installed into the housing, thus dispensing with the conventional process of installing the push button into the housing and subsequent positioning and fastening with a screw, whereby the assembling work is simplified and the assembling time becomes shorter.

The portion of the push button lug opposed to the housing side may be tapered, whereby the mounting of the push button to the housing is facilitated because the tapered surface of the lug deflects while sliding at the time of mounting the push button to the housing. The housing-side lug may be tapered as above, or both housing- and push button-side lugs may be tapered.

DESCRIPTION OF THE PREFERRED EMBODIMENTS

Figure 1:
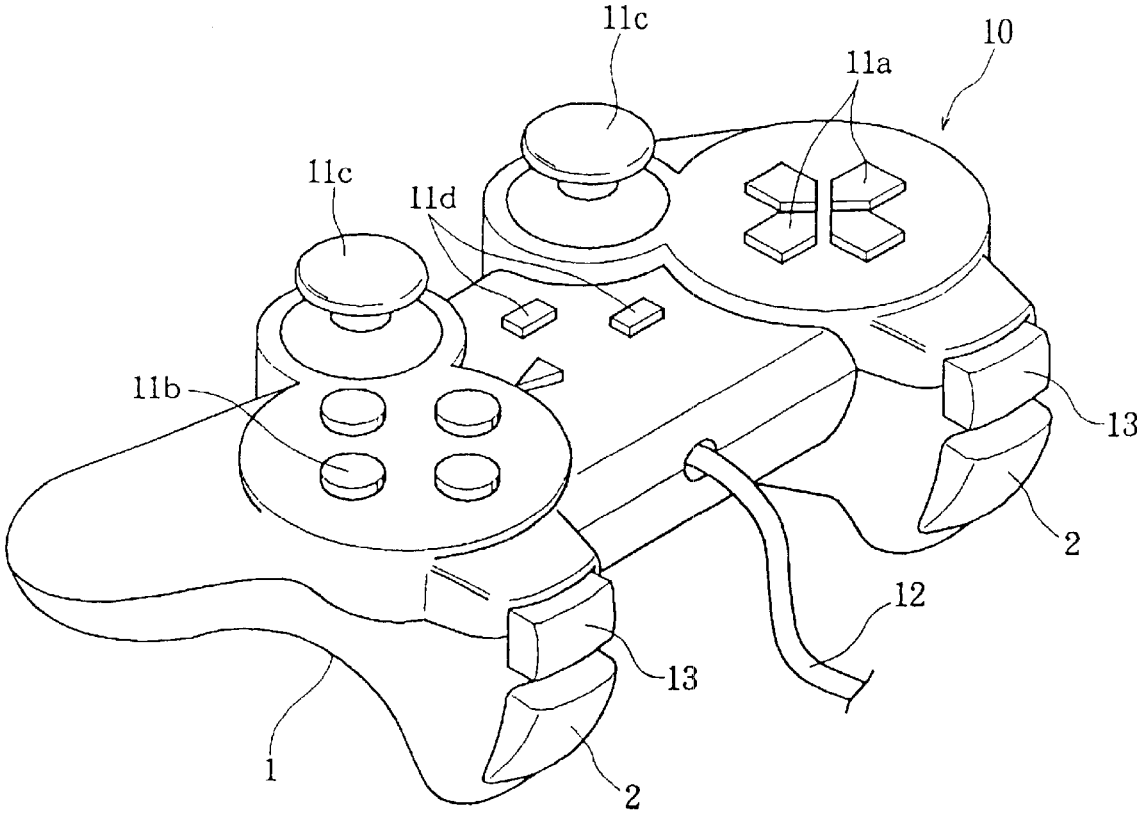
FIG. 1 is a perspective view showing an appearance of a game controller.
Figure 2:
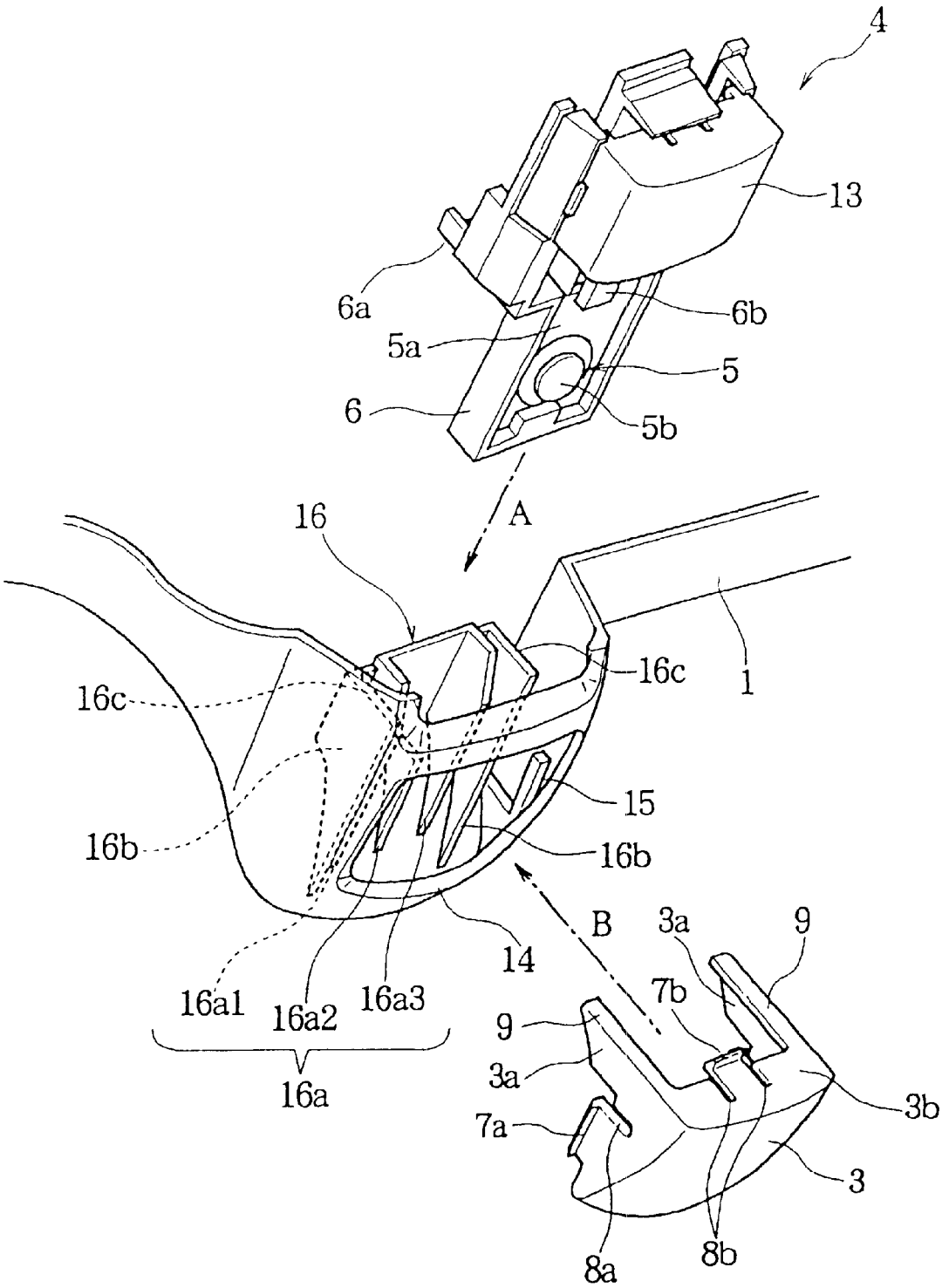
FIG. 2 is an exploded perspective view of an operating device embodying the present invention.
Figure 3:
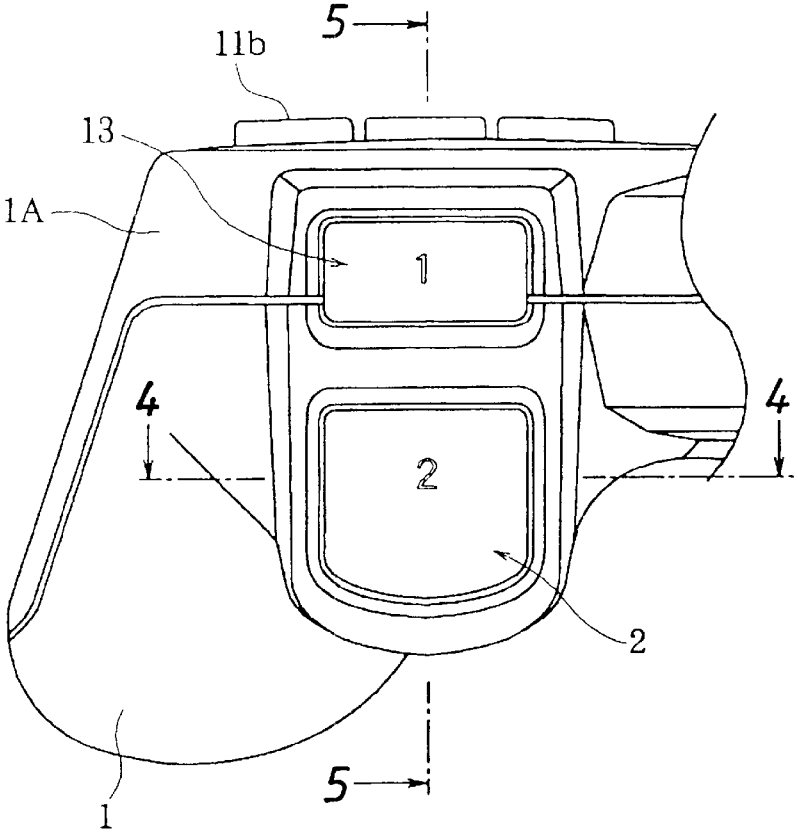
FIG. 3 is a front view thereof.
Figure 4:
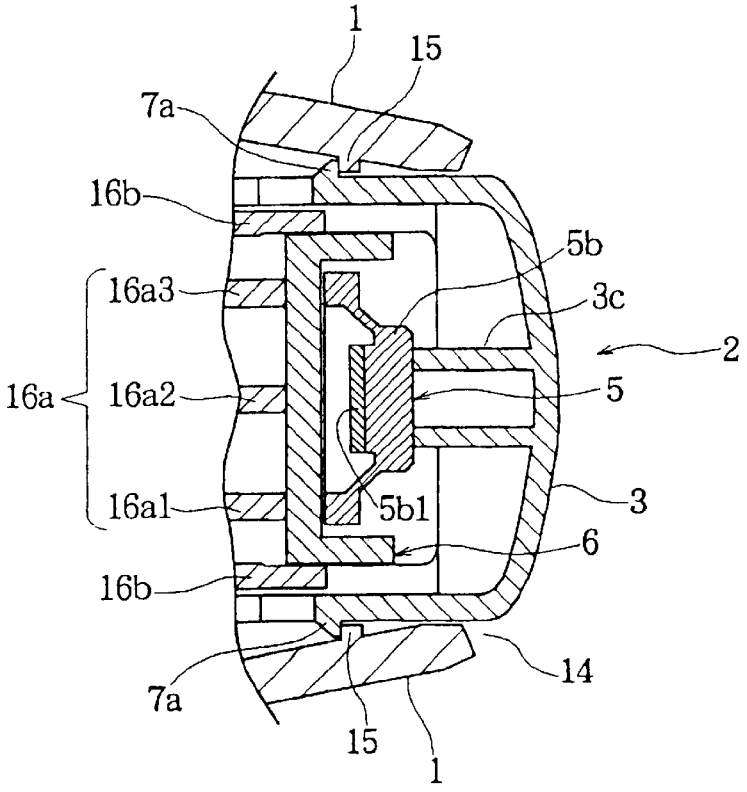
FIG. 4 is a sectional view taken on line 4—4 in FIG. 3.
Figure 5:
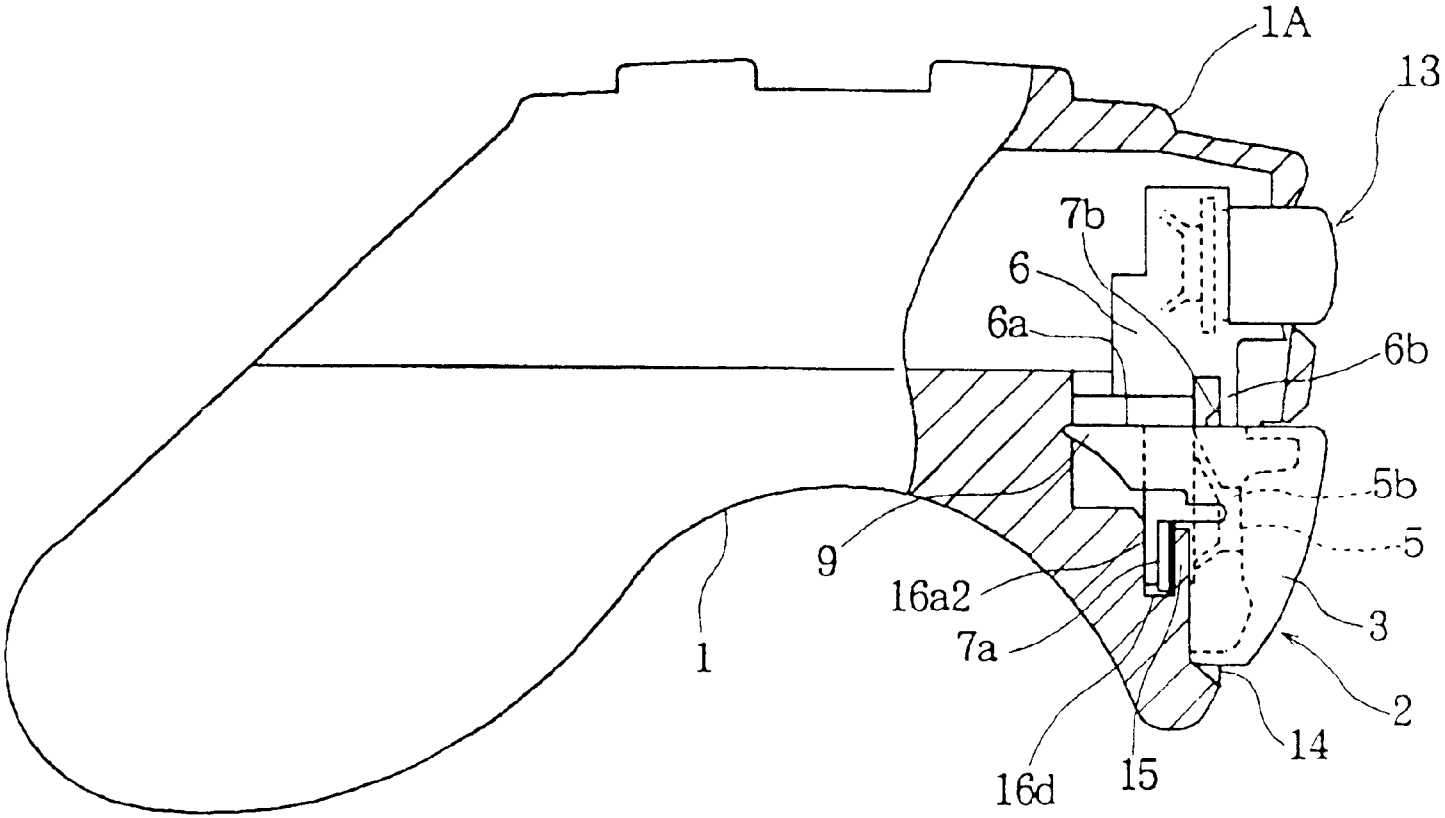
FIG. 5 is a partial sectional view taken on line 5—5 in FIG. 3.
Figure 6:
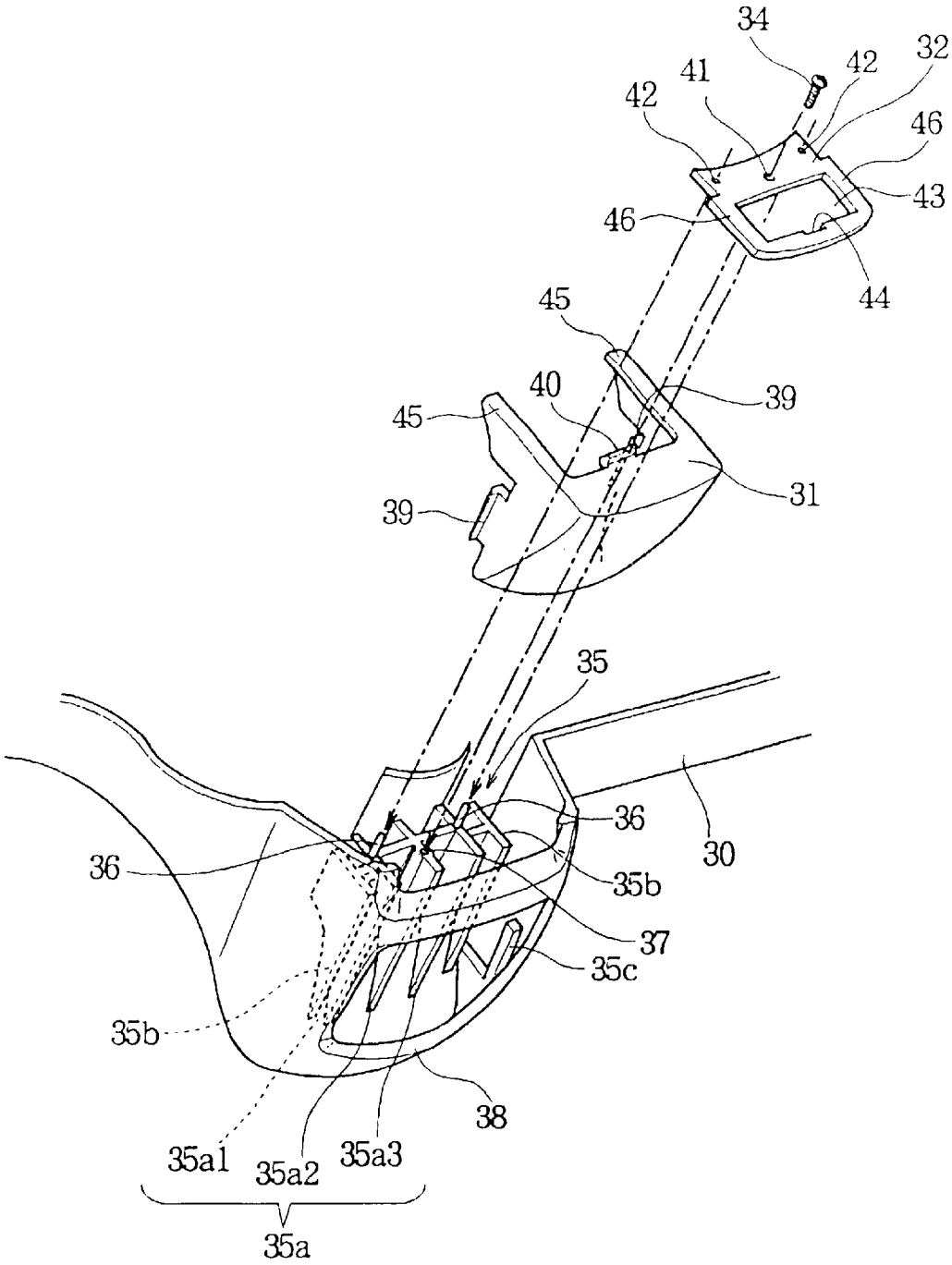
FIG. 6 PRIOR ART
FIG. 6 is an exploded perspective view of a conventional operating device.

An operating device embodying the present invention will be described herein under with reference to FIGS. 1 to 5, of which FIG. 1 is a perspective view showing an appearance of a game controller, FIG. 2 is an exploded perspective view of the operating device, FIG. 3 is a front view thereof, FIG. 4 is a sectional view taken on line 4—4 in FIG. 3, and FIG. 5 is a partial sectional view taken on line 5—5 in FIG. 3.

The operating device can be used in a game controller 10 as shown in FIG. 1 for example. The controller 10 is constituted by a combination of a lower housing 1 and an upper housing 1A. On the front side of the lower housing 1 are provided a pair of push button type input portions 2 as operating devices according to the present invention. Above the input portions 2 are provided a pair of push button type input portions 13. Further input portions 11*a*, 11*b*, 11*c*, and 11*d* are provided on an upper surface of the housing 1. These input portions are connected to a game machine body (not shown) through cable 12.

As shown in FIG. 2, the input portions 2 each comprise the housing 1, a push button 3, and a switch base 4 which comprises a switch portion 5 and a support base 6.

The front side of the push button 3 is formed as a square and curved pushing surface. Generally triangular side plates 3*a* and a generally U-shaped top plate 3*b* are integral with the front side of the push button. According to this construction, slide portions 9 of a generally inverted L-shaped section, are Ad formed respectively at both upper end corners of the push button 3.

The side plates 3*a* are formed with retaining lugs 7*a* (one is not shown) projecting sideways and the top plate 3*b* is formed with a retaining lug 7*b* projecting upward. The retaining lug 7*b* is tapered on its side opposed to the support base 6. Further, cut-in portions 8a are formed respectively in side plates 3*a* in positions above the retaining lugs 7*a* and in the pushing direction of the push button 3, thereby permitting a lateral elastic deformation of the retaining lugs 7*a*. Likewise, on both sides of the retaining lug 7*b* cut-in portions 8*b* are formed in the top plate 3*b* and in the pushing direction of the push button 3, thereby permitting a vertical elastic deformation of the retaining lug 7*b*.

The switch base 4 comprises the switch portion 5 and the support base 6. The switch portion 5 has a switch plate 5*a*, with a circular rubber cap 5*b* being attached to the switch plate 5*a* at the portion with which the push button 3 comes into abutment. When the rubber cap 5*b* is pushed by the push button 3, an electrode (not shown) formed on a filmy substrate which is formed on the surface of the switch plate 5*a*, is rendered conductive to turn the switch ON.

The support base 6 is formed so as to cover the switch portion 5 sideways and from above and below. The switch i portion 5 is provided within a recess formed in the front side of the support base 6, with the input portion 13 being provided above the switch portion 5. On both side faces of the support base 6 are formed guide portions 6*a* which extend in the pushing direction of the push button 3. Under the push button 13 is formed an anti-dislodgement retaining portion 6*b* which is generally L-shaped in vertical section and which projects downward. An upper end of the retaining portion 6*b* is integral with the support base 6.

FIG. 2 shows a part of the lower housing 1 which is in a vertically bisplit condition through a central part of the controller 10. The housing 1 is formed with a receptacle portion for the push button 3, which receptacle portion is curved in a forwardly expanded shape. In the front side of the housing 1 is formed an insertion opening 14 for insertion of the push button 3 therein. In the interior of the housing 1 is formed a support member 16 which supports the switch base 4 and which is integral with the housing. At both ends of the insertion opening 14 are formed anti-dislodgement retaining portions 15 (one is not shown) integrally with the housing 1.

The anti-dislodgement retaining portions 15 are each formed in a generally quadrangular prism shape on an inner surface of the housing 1 and are positioned (vertically) near both ends of the insertion opening 14 so as to become opposed to the retaining lugs 7*a* when the push button 3 is inserted into the housing through the insertion opening 14.

The support member 16 comprises five support plates integral with the housing 1. More specifically, three support plates 16*a* (16*a*1, 16*a*2, 16*a*3) are formed centrally and two support plates 16*b* are formed respectively on both sides of the support plates 16*a*. The support plates 16*a* are arranged in E shape when seen from above, of which the support plate 16*a*2 located centrally is formed lower than both-side support plates 16*a*1 and 16*a*3. Further, the support plates 16*b* located on both sides of the support plates 16*a* are formed lower than the support plates 16*a*1 and 16*a*3 and their front ends project to a greater extent toward the insertion opening 14 than front ends of the support plates 16*a*.

The following description is now provided about how to assemble the input portion 2 as the operating device according to the present invention.

First, the switch base 4 is attached to the housing 1. In this case, as indicated with arrow A in FIG. 2, a lower end portion of the support base 6 is inserted from above the housing 1 into a space formed between the insertion opening 14 and the support member 16. An upper end portion of the switch base 4 is secured to the upper housing 1A. When the upper housing 1A is combined with the housing 1, the lower end portion of the support base 6 as a constituent of the switch base 4 is inserted into the lower housing 1. At the time when the upper and lower housings 1A, 1 are combined together, the push buttons 3 are not installed.

At the time of the above assembly, front edges of the support plates 16*a* and the back of the support base 6 come into contact with each other and inner sides faces of the support plates 16*b* and outer side faces of the support base 6 come into contact with each other. In this state, the switch base 4 is inserted into the housing 1. As shown in the sectional view of FIG. 4, the back of the support base 6 is supported from the inner side of the housing 1 by the three support plates 16*a*1, 16*a*2 and 16*a*3, and both outer side faces of the support base 6 are supported by the inner side faces of the support plates 16*b* located on both sides and are thereby held without wobbling in the lateral direction (the vertical direction in the figure).

In a completely mounted state of the switch base 4 into the housing 1, a gap is formed between upper end faces 16*c* of the support plates 16*b* and lower surfaces of the downward guide portions 6*a* of the support base 6.

Next, the push button 3 is inserted into the insertion opening 14 of the housing 1 horizontally from the outside, as indicated with arrow B in FIG. 2.

At this time, first the slide portions 9 are inserted into the housing 1 through the insertion opening 14 and then the tapered portions formed at the front ends of the retaining lugs 7*a* come into abutment against both ends of the insertion opening 14. With a subsequent pushing force of the push button 3, the tapered portions are guided inside the insertion opening 14 and the retaining lugs 7*a* deflect inwards elastically. After passing the insertion opening 14, the retaining lugs 7*a* revert to their original state elastically. With a further insertion of the push button 3, the retaining lugs 7*a* come into abutment against the anti-dislodgement retaining portions 15. Also at this time the retaining lugs 7*a* are elastically deformed inwards, and upon getting over the anti-dislodgement retaining portions 15, the retaining lugs 7*a* revert to their original state elastically and can be engaged with the insides of the retaining portions 15.

The retaining lug 7*b* formed on the push button 3 is abutted against the lower end of the anti-dislodgement retaining portion 6*b* of the support base 6. At this time, the retaining lug 7*b* is elastically deformed downward with the guiding force of the tapered front portion of the retaining lug 7*b*, and after getting over the retaining portion 6*b* the retaining lug 7*b* reverts to its original state elastically and becomes engageable with the inside of the retaining portion 6*b*, as shown in FIG. 5.

Thus, the push button 3 is inserted into the housing while its slide portions 9 slide through the gap formed between the upper end faces 16*c* of the support plates 16*b* and the lower surfaces of the guide portions 6*a*. Since the push button 3 is mounted while the slide portions 9 are guided by the guide portions 6*a*, there is no fear of the push button 3 being mounted in an obliquely tilted state, thus permitting the retaining lugs 7*a* to surely get over the anti-dislodgement retaining portions 15. Besides, the retaining lug 7*b* can be sure to get over the anti-dislodgement retaining portion 6*b*.

As shown in FIG. 5, after the retaining lugs 7*a* get over the anti-dislodgement retaining portions 15, lower ends of the retaining lugs 7*a* slide on restricting portions 16*d* formed inside the anti-dislodgement retaining portions 15 in the housing 1. At this time the push button 3 is held between the lower surfaces of the guide portions 6*a* and the restricting portions 16*d* without wobbling in the vertical direction. Besides, since the slide portions 9 and the lower surfaces of the guide portions 6*a* are in surface contact with each other over a long distance in the pushing direction of the push button 3, the push button 3 can be operated stably in its pushing direction.

Therefore, after completion of the assembly, even if the push button 3 is pushed not at a central position but at an upper position or a lower position with respect to the central position, the push button can operate stably in its pushing direction by the sliding surface contact between the slide portions 9 and the lower surfaces of the guide portions 6*a*.

As shown in FIG. 4, moreover, since both outside faces of the push button 3 are restricted from both sides by the anti-dislodgement retaining portions 15 of the housing 1, the push button can be pushed without wobbling in the lateral direction (vertical direction in FIG. 4).

Further, as shown in FIG. 4, after the retaining lugs 7*a* get over the anti-dislodgement retaining portions 15, a tip end of a pushing portion 3*c* projecting from the back of the push button 3 comes into abutment against the rubber cap 5*b* of the switch portion 5, or the rubber cap 5*b* is pushed in slightly by the tip end. The rubber cap 5*b* creates an urging force to urge the push button 3 always in an outwardly pushing direction. With the tip end of the pushing portion 3*c* abutted against the rubber cap 5*b*, the push button 3 is retrained from both front and rear by the rubber cap 5*b* and the anti-dislodgement retaining portion 15, thus preventing the occurrence of transverse wobbling in FIG. 4.

The state shown in FIG. 4 is with switch OFF. However, when the push button 3 is pushed, the rubber cap 5*b* is pushed and deformed. After the rubber cap 5*b* has been pushed in at a predetermined stroke, an electric conductor 5*b*1 provided on the back of the switch portion 5 causes the electrode on the filmy substrate formed on the surface of the switch plate 5*a* to turn conductive, whereby the switch is turned ON.

As shown in FIG. 4, the rear side of the support base 6 is supported by the support plates 16*a* (16*a*1, 16*a*2, 16*a*3), whereby the support base 6 is prevented from wobbling in both vertical longitudinal directions. Moreover, the side faces of the support base 6 are supported by the inner side faces of the support plates 16*b*, whereby the support base is prevented from wobbling in the transverse direction. Thus, the pushing force applied to the push button 3 is borne by the support plates 16*a*.

After mounting the switch base 4 into the housing 1 in the input portion 2 as the operating device and subsequent assembly of the controller 10 except the push button 3, the push button is lastly inserted into the housing from the exterior of the controller through the insertion opening 14, whereby the assembly of the controller 10 can be completed. This assembling procedure is preferred although the push button 3 may be fitted in the housing 1 prior to insertion of the switch base 4 into the housing 1.

The operating device of the present invention is not limited to the above input portion for a game controller, but is also applicable to other push button type switches.

According to the present invention, as set forth above, since the push button can be mounted lastly after assembly of the other components, the manufacturing process is simplified and the number of components used can be decreased, thus permitting a less expensive manufacture. Additionally, the push button can operate within the housing stably without wobbling.

What is claimed is:

1. An operating device comprising a housing, a push button attached to said housing, and a switch portion, wherein a support base for supporting said switch portion is received within said housing, said push button is inserted into said housing at a position at which said push button can push said switch portion and opposedly to the switch portion, and an anti-dislodgement retaining portion for preventing said push button from coming off to an exterior of said housing is formed between said support base and said push button, and wherein said housing is provided with a restricting portion opposedly to said push button on a side opposite a guide portion to restrict a vertical movement of the push button in cooperation with the guide portion.

2. An operating device according to claim 1, wherein said support base is provided with a guide portion for restricting a movement of said push button in a direction perpendicular to a pushing direction of the push button and for guiding the movement of the push button in the pushing direction.

3. An operating device according to claim 1, wherein said anti-dislodgement retaining portion for preventing said push button from coming off to the exterior of said housing is formed between the housing and the push button.

4. An operating device according to claim 1, wherein an elastically deformable lug to be engaged with said anti-dislodgement retaining portion is formed on said push button, and the push button is inserted by snap-in fitting from the exterior of said housing into an insertion opening formed in the housing.

* * * * *